United States Patent [19]

Mowbray

[11] Patent Number: 4,652,220

[45] Date of Patent: Mar. 24, 1987

[54] LIQUID FUEL PUMPING APPARATUS

[75] Inventor: Dorian F. Mowbray, Burnham, England

[73] Assignee: Lucas Industries, Birmingham, England

[21] Appl. No.: 839,723

[22] Filed: Mar. 14, 1986

[30] Foreign Application Priority Data

Apr. 9, 1985 [GB] United Kingdom ..... 8509020

[51] Int. Cl.[4] ..... F04B 19/22

[52] U.S. Cl. ..... 417/462; 123/387; 123/450; 123/449

[58] Field of Search ..... 417/214, 462; 123/387, 123/449, 450

[56] References Cited

U.S. PATENT DOCUMENTS

| | | | |
|---|---|---|---|
| 3,046,905 | 7/1962 | Davis | 417/462 X |
| 3,485,225 | 12/1969 | Bailey et al. | 123/450 X |
| 3,910,723 | 10/1975 | Bonin | 417/214 |
| 4,299,542 | 11/1981 | Potter et al. | 417/462 X |
| 4,358,255 | 11/1982 | Brotherston | 417/462 |
| 4,378,962 | 4/1983 | Law | 417/462 |
| 4,397,615 | 8/1983 | Mowbray | 417/462 X |

*Primary Examiner*—Carlton R. Croyle
*Assistant Examiner*—Paul F. Neils
*Attorney, Agent, or Firm*—Osann, Balogh, Kramer, Dvorak, Genova & Traub

[57] ABSTRACT

A liquid fuel pumping apparatus for supplying fuel to an internal combustion engine has a rotary distributor member in which is mounted a plurality of pumping plungers which are engaged at their outer ends by cam followers which engage the internal surface of a cam ring. The distributor member is axially movable to vary the quantity of fuel supplied. Each follower includes a roller and a shoe and in order to reduce the amount of material required to produce the cam ring, the rollers are of a length substantially equal to the width of the cam ring and are held against axial movement relative to the cam ring. The shoes are held against axial movement relative to the distributor member. The width of the cam ring and the roller are such that the safe Hertzian stress in the cam ring is not exceeded, the additional width of the cam ring to accommodate the movement of the distributor member in previous designs not being required.

6 Claims, 3 Drawing Figures

LIQUID FUEL PUMPING APPARATUS

Figures 1, 2, 3:
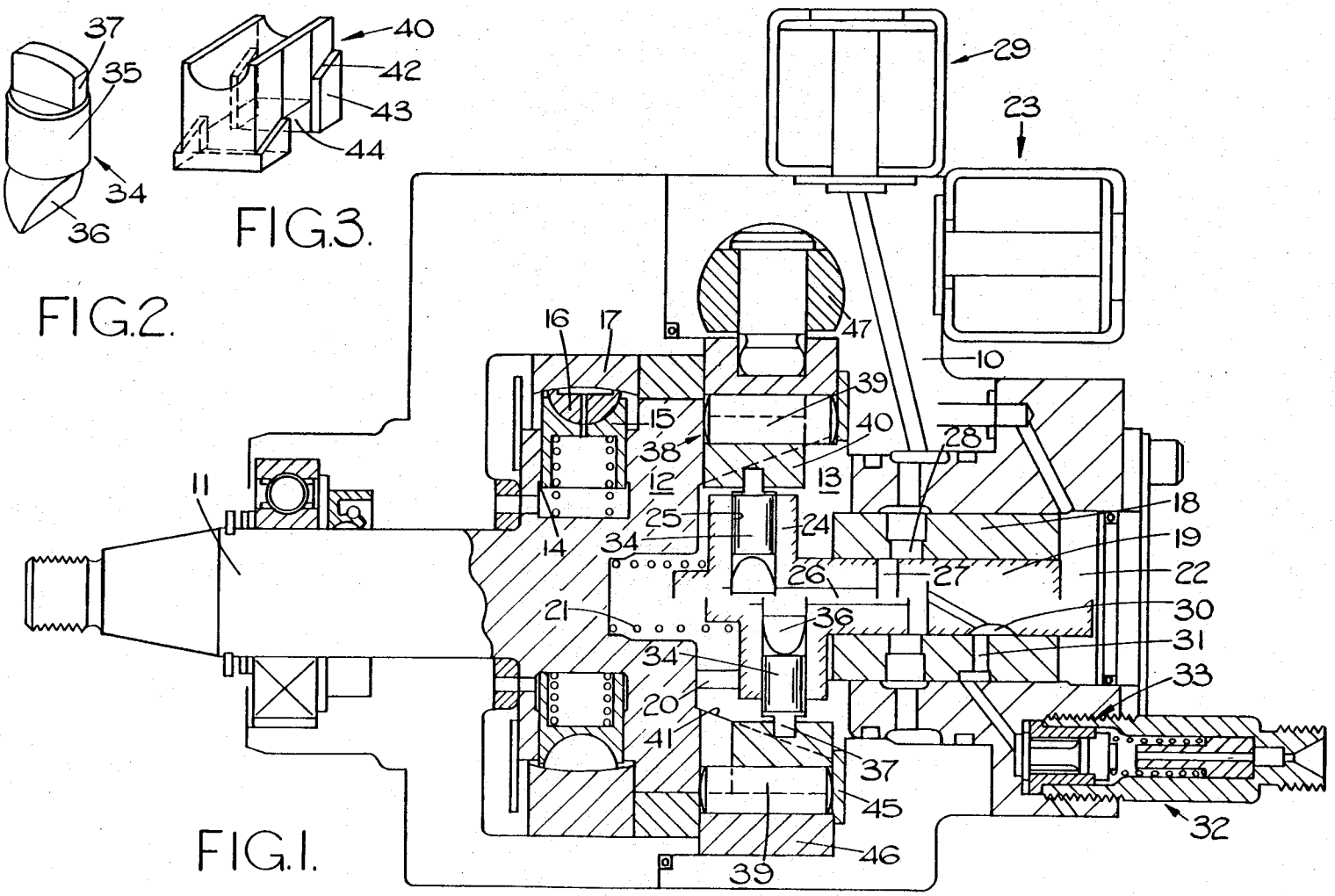

This invention relates to a liquid fuel pumping apparatus for supplying fuel to an internal combustion engine, the apparatus being of the kind comprising a distributor member mounted for rotation within a housing, a drive shaft for driving the distributor member, the drive shaft in use being driven from the associated engine, a plunger mounted within a radial bore in the distributor member, a cam follower located at the outer end of the plunger, an annular cam ring mounted in the housing the cam ring having on its internal peripheral surface a plurality of cam lobes, said cam follower comprising a roller which engages said cam lobes and a shoe which defines a cylindrical recess in which the roller is located, passage means in the distributor member and housing through which fuel can flow to the bore from a source of fuel and from the bore to an outlet, co-operating stop means on the drive shaft and shoe for limiting the outward movement of the plunger, said distributor member being axially adjustable to enable the limit position of the plunger to be varied and means for controlling the axial position of the distributor member.

An apparatus of the aforesaid kind is known from British specification No. 2037365B. In the apparatus described in this specification the roller and shoe of the cam follower are located relative to the distributor member so that they move axially therewith as adjustment of the distributor member takes place. The practical effect of this is that the axial length of the cam ring must be at least equal to the length of the roller plus the allowed axial movement of the distributor member. The length of the roller has to be determined bearing in mind the safe Hertzian stress of the cam ring, it being appreciated that line contact exists between the roller and cam surface. The loading between the roller and the cylindrical surface of the shoe is considerably less and is not critical in the calculation of the length of the roller. In order to withstand the stresses involved the cam ring is formed from expensive alloy steel. One object of the invention is to reduce the axial length of the cam ring and thereby the amount of material used in its construction.

The stresses imparted to the cam ring during operation of the apparatus particularly where a high fuel pumping rate is required can be reduced by increasing the number of plungers. For reasons of balance, at least two plungers are employed but the forces on the cam ring can be reduced significantly if four or more plungers are employed, this having the effect of reducing the distortion of the cam ring and hence allowing the thickness of the cam ring to be reduced. This allows a further saving in the quantity of expensive alloy steel used in the manufacture of the cam ring and also reduces the inertia of the cam ring this facilitating movement of the cam ring for timing control. There is however a practical difficulty with this arrangement which arises because a large space is left at the inner ends of the bores which accommodate the plungers. This space constitutes dead volume and can affect the operating characteristics of the apparatus. It is known to provide wedge-like extensions on the inner ends of the plungers, the extensions coming together as the plungers move inwardly to occupy the aforesaid space thereby minimising the dead volume. The plungers however must be correctly positioned in the bores otherwise there may be physical engagement between the extensions of two or more of the plungers and this can cause damage. Various proposals have been made to prevent such engagement but none can be considered entirely satisfactory. Accordingly it is a further object of the invention to provide an apparatus of the kind specified incorporating a plurality of plungers and having means for retaining the plungers against rotation.

According to the invention an apparatus of the kind specified comprises further means restraining said roller against axial movement relative to the cam ring said roller being of a length substantially equal to the axial length of the cam ring, and said shoe is restrained against axial movement relative to the distributor member whereby as axial movement of the distributor member takes place in order to adjust the quantity of fuel supplied, relative axial movement takes place between the roller and the shoe.

According to another aspect of the invention the apparatus has a plurality of plungers and respective cam followers, the plungers being mounted in respective radial bores formed in the distributor member and interconnected at their inner ends, the plungers having wedge elements at their inner ends which as the plungers are moved inwardly move to occupy the space defined at the inner ends of the bores, the plungers at their outer ends being non-rotatably connected to the associated shoes of the cam followers said shoes being located against angular movement about the longitudinal axis of the pumping plungers whereby said plungers are restrained against angular movement within their bores.

An example of a fuel pumping apparatus in accordance with the invention will now be described with reference to the accompanying drawings in which:

FIG. 1 is a sectional side elevation of the apparatus showing a part of the apparatus in alternative positions, FIG. 2 is a perspective view of part of the apparatus shown in FIG. 1, and FIG. 3 is a perspective view of a further part of the apparatus seen in FIG. 1.

Referring to the drawings, the apparatus comprises a multi-part housing 10 in one part of which is mounted a drive shaft 11 which in use is coupled to a rotary part of the associated engine. The drive shaft has an inner end portion 12 of enlarged diameter which is located within a space 13 defined in the housing and formed in the enlarged portion of the drive shaft are a plurality of cylinders 14 in which are located pumping pistons 15 respectively which are urged outwardly by respective springs so that slippers 16 at the outer ends of the pistons, engage with a cam surface formed on a cam ring 17 secured within the housing. The pistons 15 constitute a low pressure pump which supplies fuel at low pressure to a high pressure injection pump housed within the apparatus.

Slidable within a sleeve 18 secured in another part of the housing, is a rotary cylindrical distributor member 19. The distributor member is coupled to the drive shaft 11 by means of a pin 20 whereby the distributor member rotates with the drive shaft in synchronism with the associated engine. The distributor member is biased towards the right as shown in the drawings, by means of a coiled compression spring 21 extending between the distributor member and the drive shaft and it can be moved against the action of the spring 21 by admitting fuel under pressure from the low pressure pump, to a chamber 22 defined by the housing at the remote of the distributor member. The pressure in the chamber is conveniently controlled electrically using an electromagnetic valve generally indicated at 23 the flow of current in the winding of which is controlled by an electronic control system (not shown) which is responsive to various engine operating parameters and desired operating parameters.

The distributor member 19 has an enlarged portion 24 in the chamber 13 and defined in the enlarged portion of the distributor member is a plurality, in the example, 6, radially extending bores 25 which are interconnected at their inner ends and connect with an axially extending passage 26 formed in the distributor member. The passage 26 communicates with a plurality of radially extending inlet passages 27 which can communicate with inlet ports 28 formed in the aforesaid sleeve during the filling period of the bores 25. The ports 28 communicate with the outlet of the low pressure pump by way of an electromagnetically operated valve 29 which can be closed when it is desired to halt the supply of fuel to the associated engine.

The passage 26 also communicates with a delivery slot 30 formed in the periphery of the distributor member and which is arranged to register in turn as the distributor member rotates, with a plurality of outlet ports 31 formed in the aforesaid sleeve and which extend respectively to outlets 32 on the exterior of the housing. The outlets in use are connected to the injection nozzles respectively of the associated engine. As shown, each outlet 32 incorporates an unloading delivery valve 33 of conventional construction.

Housed within the bores 25 are respective pumping plungers 34, these being shown in perspective view in FIG. 2. The plungers have a central cylindrical portion 35, wedge elements 36 at their inner ends and tongue elements 37 at their outer ends. The plane surfaces of the wedge elements extend in planes parallel to the axis of rotation of the distributor member so that as the plungers are moved inwardly as will be described, the wedge elements 36 occupy the space defined at the inner ends of the bores to reduce the dead volume of fuel contained within the distributor member.

Cam followers generally indicated at 38, are located at the outer ends of the plungers respectively and each cam follower comprises a roller 39 and a shoe 40. A perspective view of the shoe is seen in FIG 3. The cam followers are located in radial slots formed in an extension of the enlarged portion 12 of the drive shaft whereby the torque required to drive the cam followers will be derived directly from the drive shaft. The inner surface of the extension of the enlarged portion of the drive shaft is flared outwardly to define inclined stop surfaces 41. The surfaces 41 co-operate with complementary stop surfaces 42 formed on lateral extensions 43 on the sides of the shoes. Moreover, each cam follower is provided with a circumferential slot 44 which is occupied by the tongue element 37 of the associated plunger. The tongue element and the slot 44 restrain the plunger 34 against angular movement since angular movement of the shoe is restrained by the fact that it is located in a radial slot. Moreover, the shoe the axial length of which is less than the axial length of the associated roller, is restrained against axial movement relative to the distributor member. The rollers 39 have an increased axial length as compared with the shoes and the rollers 39 are restrained against axial movement in one direction by a thrust plate 45 located within the chamber 13 and by the enlarged portion 12 of the drive shaft in the opposite direction.

The rollers engage with the internal peripheral surface of an annular cam ring 46 secured against axial movement within the housing. The angular adjustment of the cam ring can be varied in known manner using a fuel pressure actuated piston 47 the application of fuel pressure to which may be controlled by a further electromagnetic valve.

On the internal peripheral surface of the cam ring is formed a plurality of cam lobes positioned so that as the drive shaft rotates, inward movement will be imparted to all the plungers at the same time and fuel will be displaced from the inner ends of the bores 25 and will flow to the delivery groove 30 and to an outlet port 31. As the distributor member continues to rotate, the cam lobes will permit outward movement of the plungers such outward movement being effected by fuel flowing through the inlet ports 28 to the inlet passages 27. The extent of outward movement of the plungers is limited by the abutment of the stop surfaces 41 and 42 and in this manner by varying the axial position of the distributor member the amount of fuel supplied by the apparatus at each injection stroke can be varied.

By employing a large number of plungers the rate of delivery of fuel can be extremely high but since there are a large number of plungers the stress on and distortion of the cam ring 46 is minimised and so the thickness of the ring can be reduced as compared to the case where only two plungers are provided. The axial length of the cam ring and the rollers is chosen so that the safe Hertzian stress in the cam ring is not exceeded. In this manner the axial length of the cam ring is reduced as compared for example with the cam ring shown in the specification of British Patent 2037365B. In manufacturing the plungers it is convenient to make the radial dimension of the wedge elements and tongue elements slightly smaller than the central cylindrical portion 35, to allow accurate centreless grinding of the cylindrical portion.

I claim:

1. A liquid fuel pumping apparatus for supplying fuel to an internal combustion engine comprising a distributor member mounted for rotation within a housing, a drive shaft for driving the distributor member, the drive shaft in use being driven from the associated engine, a plunger mounted within a radial bore in the distributor member, a cam follower located at the outer end of the plunger, an annular cam ring mounted in the housing the cam ring having on its internal peripheral surface a plurality of cam lobes, said cam follower comprising a roller which engages said cam lobes and a shoe which defines a cylindrical recess in which the roller is located, passage means in the distributor member and housing through which fuel can flow to the bore from a source of fuel and from the bore to an outlet, co-operating stop means on the drive shaft and shoe for limiting the outward movement of the plunger, said distributor member being axially adjustable to enable the limit position of the plunger to be varied, means for controlling the axial position of the distributor member, further means for restraining said roller against axial movement relative to the cam ring said roller being of a length substantially equal to the axial length of the cam ring, and said shoe is restrained against axial movement relative to the distributor member whereby as axial movement of the distributor member takes place in order to adjust the quantity of fuel supplied, relative axial movement takes place between the roller and the shoe.

2. An apparatus according to claim 1 in which the presented surfaces of the plunger and shoe define a tongue and slot connection with the tongue and slot extending circumferentially about the axis of rotation of the distributor member, whereby relative axial movement of the shoe and distributor member is prevented.

3. An apparatus according to claim 1 in which said further means comprises a pair of surfaces disposed at the opposite ends respectively of the roller, a thrust plate mounted within the housing defining one of said surfaces and an enlarged portion of the drive shaft defining the other of said surfaces.

4. An apparatus according to claim 2 in which the presented surfaces of the plunger and shoe define a tongue and slot connection with the tongue and slot extending circumferentially about the axis of rotation of the distributor member, whereby relative axial movement of the shoe and distributor member is prevented.

5. An apparatus according to claim 1 including a plurality of plungers and respective cam followers, the plungers being mounted in respective radial bores formed in the distributor member and interconnected at their inner ends, the plungers having wedge elements at their inner ends which as the plungers are moved inwardly move to occupy the space defined at the inner ends of the bores, the plungers at their outer ends being non-rotatably connected to the associated shoes of the cam followers said shoes being located against angular movement about the longitudinal axis of the pumping plungers whereby said plungers are restrained against angular movement within their bores.

6. An apparatus according to claim 5 in which said drive shaft has an enlarged portion which surrounds the portion of the distributor member in which said plungers are mounted, said enlarged portion of the drive shaft defining slots to accommodate said cam followers, the walls of said slots acting to prevent angular movement of the shoes about the axes of the plungers and thereby preventing angular movement of the plungers.

* * * * *